US011987921B2

(12) United States Patent
Zattin et al.

(10) Patent No.: US 11,987,921 B2
(45) Date of Patent: May 21, 2024

(54) LAUNDRY TREATMENT APPLIANCE WITH WATER SOFTENING SYSTEM

(71) Applicant: Electrolux Appliances Aktiebolag, Stockholm (SE)

(72) Inventors: Andrea Zattin, Solesino (IT); Martino Bondi, Sesto Al Reghena (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 60 days.

(21) Appl. No.: 17/712,652

(22) Filed: Apr. 4, 2022

(65) Prior Publication Data

US 2022/0333288 A1 Oct. 20, 2022

(30) Foreign Application Priority Data

Apr. 15, 2021 (EP) ..... 21168672

(51) Int. Cl.
*D06F 39/00* (2020.01)
*D06F 34/22* (2020.01)
(Continued)

(52) U.S. Cl.
CPC ..... *D06F 39/007* (2013.01); *D06F 34/22* (2020.02); *D06F 39/02* (2013.01); *D06F 39/088* (2013.01);
(Continued)

(58) Field of Classification Search
None
See application file for complete search history.

(56) References Cited

U.S. PATENT DOCUMENTS

2008/0271500 A1* 11/2008 Ahn ..... D06F 39/008 68/5 C
2010/0287709 A1* 11/2010 Doyle ..... D06F 33/32 68/12.18
(Continued)

FOREIGN PATENT DOCUMENTS

EP 2486180 A1 8/2012
EP 2565319 A1 3/2013
(Continued)

OTHER PUBLICATIONS

Extended European Search Report for European Application No. 21168663.9, dated Sep. 22, 2021, 10 pages.
(Continued)

*Primary Examiner* — Cristi J Tate-Sims
(74) *Attorney, Agent, or Firm* — Bradley Arant Boult Cummings LLP

(57) ABSTRACT

A laundry treatment appliance comprising: a fresh water supply; a treatment chamber; a water softener; a liquid delivery system connected to the water supply, the water softener, and a treatment agent delivery system configured to store a water-soluble treating agent pod and/or a steam generator. The liquid delivery system is configured to supply fresh water from the water supply or soft water from the water softener into the treatment chamber. The appliance can perform one or more treatment cycles including at least one of: a first cycle in which the process liquid supplied by said process liquid delivery system further includes laundry treatment agents contained in the pod, and a second cycle in which the steam generator is activated to steam into the treatment chamber. The appliance further comprises a control unit to activate the water softener to provide the process liquid delivery system with soft water.

16 Claims, 4 Drawing Sheets

(51) Int. Cl.

| | |
|---|---|
| ***D06F 39/02*** | (2006.01) |
| ***D06F 39/08*** | (2006.01) |
| ***D06F 39/40*** | (2024.01) |
| *D06F 101/20* | (2020.01) |
| *D06F 103/20* | (2020.01) |
| *D06F 105/52* | (2020.01) |

(52) U.S. Cl.
CPC ..... *D06F 39/40* (2024.01); *D06F 2101/20* (2020.02); *D06F 2103/20* (2020.02); *D06F 2105/52* (2020.02)

(56) References Cited

U.S. PATENT DOCUMENTS

| | | | | |
|---|---|---|---|---|
| 2016/0326681 | A1* | 11/2016 | Stabon | G05B 19/409 |
| 2017/0350060 | A1* | 12/2017 | Favaro | D06F 39/028 |

FOREIGN PATENT DOCUMENTS

| | | | | |
|---|---|---|---|---|
| EP | 3293302 | A1 | 3/2018 | |
| EP | 3617379 | A1 | 3/2020 | |
| IT | 201900007668 | A1 | 11/2020 | |
| KR | 20060036754 | A | 5/2006 | |
| KR | 20140126896 | A | 11/2014 | |
| WO | 2011042341 | A1 | 4/2011 | |
| WO | WO-2011094852 | A1 * | 8/2011 | A47L 15/4229 |
| WO | 2016062349 | A1 | 4/2016 | |
| WO | 2016101994 | A1 | 6/2016 | |
| WO | 2020006951 | A1 | 1/2020 | |

OTHER PUBLICATIONS

Extended European Search Report for European Application No. 21168672.0, dated Sep. 24, 2021, 9 pages.

* cited by examiner

LAUNDRY TREATMENT APPLIANCE WITH WATER SOFTENING SYSTEM

This application claims priority to European Patent Application No. EP 21168672.0, filed Apr. 15, 2021, which is incorporated herein by reference.

FIELD OF THE INVENTION

The present invention generally relates to the field of laundry treatment appliances (hereinafter, concisely, "laundry appliances"), and particularly to laundry appliances for treating, e.g. washing, laundry, such as laundry washing appliances and laundry washing appliances also implementing laundry drying functions (also referred to as washers/dryers).

BACKGROUND OF THE INVENTION

A conventional laundry appliance is configured to treat laundry located in a laundry treatment chamber comprising a (e.g., rotatable) drum by providing process liquids in a washing tub housing the rotatable drum.

Process liquids may comprise, e.g. depending on a selected treatment cycle and/or on a current phase of the selected treatment cycle, plain water or a treatment mixture comprising water mixed with proper (e.g., liquid and powder) treatment agents, including, but not limited to, washing detergents, rinsing detergents, bleaches and softeners detergents, dyes, fragrances, additives.

In addition to, or in place of, traditional liquid or powder treatment agents, unit dose packages have been introduced in the market wherein a unit dose package comprises a pre-measured amount of one or more laundry treatment agents incorporated into a water-soluble pouch. For the sake of conciseness, said unit dose packages will be hereinafter referred to as "water-soluble pods", or simply "pods". An example of a laundry appliance equipped with drawer suitable to receive a pod is disclosed in the patent application EP3293302.

Laundry appliances capable of carrying out a steam treatment cycle wherein steam is supplied into the laundry treatment chamber for refreshing the laundry, and/or smoothing out wrinkles from the laundry are known. For this purpose, an amount of process liquid, e.g., plain water or water mixed with a fragrance, is heated up by a heating resistor to a sufficiently high temperature for the generation of steam.

The hardness of the water (i.e., the amount of minerals, largely calcium and magnesium, dissolved in the water) may negatively affect the performance of a laundry appliance. Indeed, laundry treated using excessively hard water may require higher temperatures, and even if high temperatures are used, the result of the laundry treatment can be not satisfactory. Moreover, laundry treated using hard water may become stiff, subjected to premature tear and wear, and cause skin irritation. Hardness of water strongly influences also the amount of treatment agents required to obtain a satisfactory laundry treatment. Generally, the higher the hardness of water, the larger the amount of treatment agent required.

In addition, the parts of the laundry appliance that are in direct contact with water (e.g., ducts, tanks, valves, heater resistors) may become encrusted with limestone, thereby impairing the correct operation of the laundry appliance. Making reference to a laundry treatment appliance configured to carry a steam treatment cycle, if the heating resistor used for the generation of the steam becomes encrusted, the generation of steam is negatively affected.

For that reason, it is known to equip the laundry appliance with a water softening system configured to reduce the hardness of water, so that the laundry can be advantageously treated with softer water. A water softening system comprises a container containing a water softening agent (e.g., a ion-exchange resin) capable of reducing hardness of water by promoting exchange of the minerals dissolved in water causing hardness (e.g., calcium and magnesium) for a soft mineral that does not build up on surfaces, such as sodium. After several uses, the water softening agent gets exhausted, which strongly reduces water softening performance. For this reason, the water softening system typically comprises a (refillable) container for storing a regenerating agent, usually salt (e.g., Sodium chloride salt), to be used for regenerating the exhausted softening agent during a water softening agent regeneration procedure.

US2008271500 discloses a laundry machine including a body for defining an exterior, a water supply valve provided in the body and connected with an outer water supply device, a drum rotatably mounted within the body, at least one steam generator for supplying steam into the drum, and a water treatment apparatus for treating water supplied to the steam generator.

SUMMARY OF INVENTION

The Applicant has realized that the known laundry appliances are affected by drawbacks in the water hardness management that impair their efficiency as well as the reliability of the laundry treatment operations.

If the hardness of water fed to a laundry appliance configured to carry out treatment cycles exploiting pods is particularly high, using a single pod to perform a treatment cycle could not guarantee a satisfying result. In this case, the user of the laundry appliance is forced to manually add one or more additional pods for obtaining a better washing result, thereby increasing the environmental impact of the treatment cycle as well as its cost.

Moreover, the known laundry appliances equipped with a water softening system configured to reduce the hardness of water, such as the one disclosed in US2008271500, are not efficient because of the relatively high frequency with which the user is forced to provide new amounts of regenerating agent (e.g., salt) to guarantee the correct execution of water softening agent regeneration procedures.

In general, according the solutions known in the art, in order to correctly operate a laundry appliance in presence of hard water, the user is forced to carry out a number of manual operations for configuring the appliance and/or the selected treatment cycle.

In view of the above, Applicant has devised a solution that is able to efficiently manage the hardness of water provided to a laundry appliance in an automated way, without requiring (or at least reducing) a manual intervention of the user.

An aspect of the present invention relates to a laundry treatment appliance.

The laundry treatment appliance comprises a water supply unit configured to supply fresh water to the laundry treatment appliance.

The laundry treatment appliance comprises a laundry treatment chamber adapted to receive laundry to be treated.

The laundry treatment appliance comprises a water softening system configured to receive fresh water from the water supply unit and to generate soft water from the received fresh water.

The laundry treatment appliance comprises a device for generating steam to be supplied into the laundry treatment chamber, and/or a treatment agent delivery system configured to store a water-soluble pod containing one or more laundry treatment agents.

The laundry treatment appliance comprises a process liquid delivery system fluidly connected to said water supply unit and to said water softening system.

The process liquid delivery system is further fluidly connected to said treatment agent delivery system and/or to said device for generating steam.

The process liquid delivery system is configured for supplying process liquid comprising fresh water supplied by the water supply unit or soft water generated by the water softening system into the laundry treatment chamber.

The laundry treatment appliance is configured to perform at least one among a set of treatment cycles selectable by a user.

Said set of treatment cycles comprises at least:

- a first treatment cycle in which said process liquid supplied by said process liquid delivery system further comprises said one or more laundry treatment agents contained in said water-soluble pod, and/or
- a second treatment cycle in which the device for generating steam is activated for supplying steam into the laundry treatment chamber using water supplied by the process liquid delivery system.

The laundry treatment appliance further comprises a control unit.

The control unit is configured to activate the water softening system so as to provide the process liquid delivery system with soft water when one of said treatment cycles of the set is selected.

According to an embodiment of the present invention, the control unit is configured to deactivate the water softening system so as to provide the process liquid delivery system with fresh water supplied by the water supply unit when none of said treatment cycles of the set is selected.

The automatic activation (and, optionally, deactivation) of the water softening system of the proposed solution allows to strongly reduce the operations to be manually performed by the user.

Thanks to the proposed solution, the water softening system is automatically activated when the selected treatment cycle may benefit from exploiting softened water.

When a treatment cycle is selected involving pods, the automatic activation of the water softening system advantageously avoids the need of adding more pods for counterbalancing the negative impact of hard water on the washing result.

When a treatment cycle is selected involving the generation of steam into the laundry treatment chamber, the automatic activation of the water softening system advantageously avoids (or at least strongly reduces) encrustations of the heating resistor used to generate steam, improving the efficiency as well as reducing the electric power consumption.

Moreover, since the water softening system is activated only when required, the number of times a water softening agent regeneration procedure is carried out is advantageously reduced, reducing therefore the frequency with which the user is forced to provide new amounts of salt to guarantee the correct execution of water softening agent regeneration procedures.

According to an embodiment of the invention, the control unit is configured to activate the water softening system so as to provide the process liquid delivery system with soft water when one of said treatment cycles of the set is selected and hardness of said fresh water is above a predefined threshold.

The automatic activation of the water softening system based on the actual level of hardness of the water is particularly advantageous, since this parameter may be not known by the user of the laundry appliance.

According to an embodiment of the present invention, the control unit is configured to activate the water softening system so as to provide the process liquid delivery system with soft water when one of said treatment cycles of the set is selected and no regeneration of the water softening system is required.

In this way, it is assured that the water softening system is activated only when it is in a condition to correctly operate (i.e., when no regeneration of the water softening system is required).

According to an embodiment of the present invention, the water softening system comprises a water tank configured to store softened water.

According to an embodiment of the present invention, the water softening system is configured to supply soft water contained in said water tank to said process liquid delivery system.

In this way, the laundry appliance is advantageously provided with a reserve of already available softened water.

According to an embodiment of the present invention, said water softening system comprises a water softening agent container storing a water softening agent capable of reducing hardness of water, configured to be selectively in fluid communication with said fresh water supply unit.

According to an embodiment of the present invention, said water tank has an input configured to be selectively in fluid communication with an output of said water softening agent container, and an output in fluid communication with said process liquid delivery system. Having most of the hydraulic circuit of the laundry appliance that is downstream the water tank storing softened water, the formation of limestone in said hydraulic circuit is advantageously prevented.

According to an embodiment of the present invention, the control unit is configured to activate the water softening system so as to provide the process liquid delivery system with soft water based on an amount of soft water stored in the water tank.

According to an embodiment of the present invention, said water softening agent container storing a water softening agent capable of reducing hardness of water has an output fluidly connected with said process liquid delivery system.

According to an embodiment of the present invention, the control unit is configured to activate the water softening system when one of said treatment cycles of the set is selected and said amount of soft water stored in the water tank is higher than a predefined soft water amount threshold.

In this way, it is assured that the water softening system is activated only when it is in a condition to correctly operate (i.e., when the water tank comprises a sufficient amount of softened water).

According to an embodiment of the present invention, the treatment agent delivery system is further configured to store a fragrance.

According to an embodiment of the present invention, said set of treatment cycles further comprises a third treatment cycle in which said process liquid supplied by said delivery system further comprises said fragrance.

According to an embodiment of the present invention, the laundry treatment appliance further comprises a user interface.

According to an embodiment of the present invention, the control unit is further configured to set one of said treatment cycles in response to selection input provided by a user through said user interface.

According to an embodiment of the present invention, said control unit is configured to automatically activate the water softening system so as to provide the process liquid delivery system with soft water when water-soluble pod is received in said treatment agent delivery system.

According to an embodiment of the present invention, said treatment agent delivery system comprises at least one pod compartment adapted to receive said water-soluble pod.

According to an embodiment of the present invention, said treatment agent delivery system comprises at least one fragrance compartment adapted to receive said fragrance.

According to an embodiment of the present invention, said device for generating steam comprises a heating element located at a bottom portion of the laundry treatment chamber.

Another aspect of the present invention relates to a method for operating a laundry treatment appliance.

The laundry treatment agent comprises a water supply unit configured to supply fresh water to the laundry treatment appliance.

The laundry treatment agent comprises a laundry treatment chamber adapted to receive laundry to be treated.

The laundry treatment agent comprises a water softening system configured to receive fresh water from the water supply unit and to generate soft water from the received fresh water.

The laundry treatment agent comprises a device for generating steam to be supplied into the laundry treatment chamber, and/or a treatment agent delivery system configured to store a water-soluble pod containing one or more laundry treatment agents.

The laundry treatment agent comprises a process liquid delivery system fluidly connected to said water supply unit and to said water softening system.

The process liquid delivery system is fluidly connected to said treatment agent delivery system, and/or to said device for generating steam.

The process liquid delivery system is configured for supplying process liquid comprising fresh water supplied by the water supply unit or soft water generated by the water softening system into the laundry treatment chamber.

The laundry treatment appliance is configured to perform at least one among a set of treatment cycles selectable by a user, said set of treatment cycles comprising at least:

- a first treatment cycle in which said process liquid supplied by said process liquid delivery system further comprises said one or more laundry treatment agents contained in said water-soluble pod, and/or
- a second treatment cycle in which the device for generating steam is activated for supplying steam into the laundry treatment chamber using water supplied by the process liquid delivery system.

The method comprises:

- selecting a treatment cycle to be performed by the laundry treatment appliance;
- performing the selected treatment cycle by activating the water softening system so as to provide the process liquid delivery system with soft water if said selected treatment cycle is a treatment cycle of said set of treatment cycles.

According to an embodiment of the present invention, the method further comprising having the laundry treatment appliance perform the selected treatment cycle by deactivating the water softening system so as provide the process liquid delivery system with fresh water supplied by the water supply unit if said selected treatment cycle is not a treatment cycle of said set of treatment cycles.

According to an embodiment of the invention, the method further comprises activating the water softening system so as to provide the process liquid delivery system with soft water when said selected treatment cycle is a treatment cycle of said set of treatment cycles and hardness of said fresh water is above a predefined threshold.

According to an embodiment of the invention, the method further comprises activating the water softening system so as to provide the process liquid delivery system with soft water when said selected treatment cycle is a treatment cycle of said set of treatment cycles and no regeneration of the water softening system is required.

According to an embodiment of the invention, the treatment agent delivery system is further configured to store a fragrance, said set of treatment cycles further comprising a third treatment cycle in which said process liquid supplied by said delivery system further comprises said fragrance.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read referring to the attached drawings, wherein.

DETAILED DESCRIPTION OF PREFERRED EMBODIMENTS OF THE PRESENT INVENTION

Figure 1A:
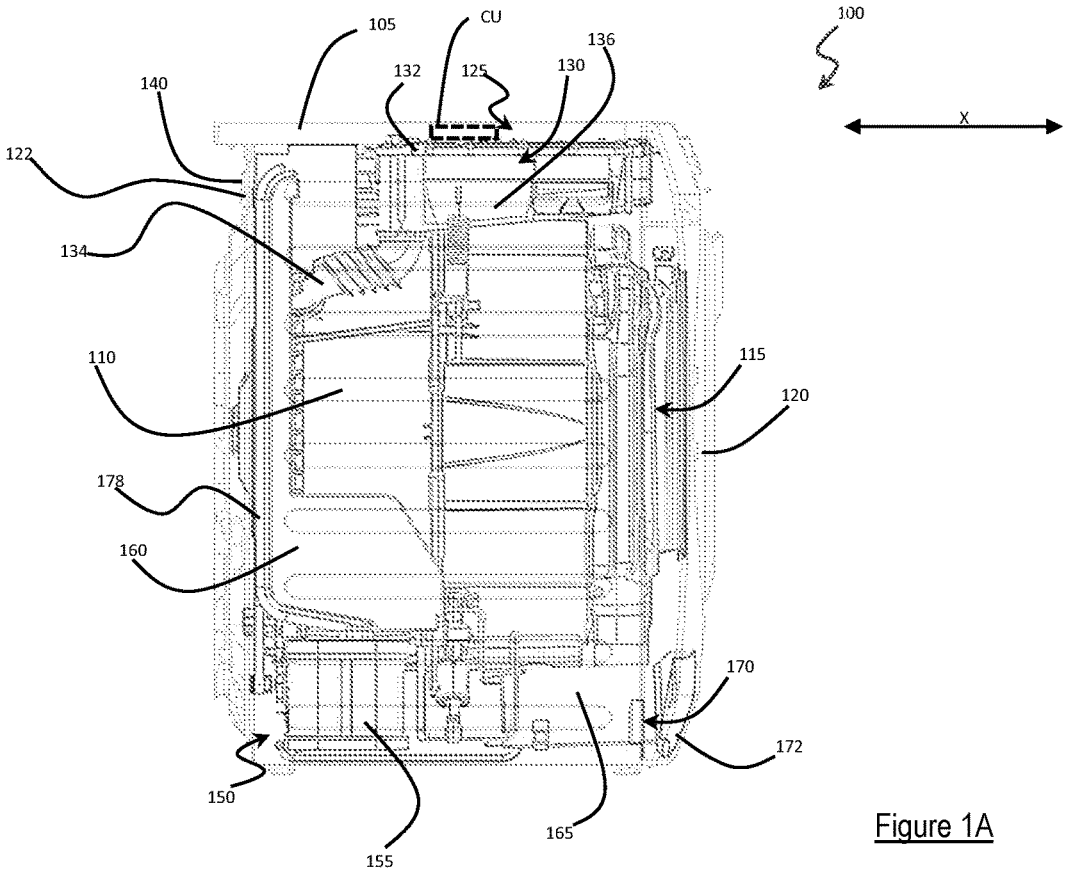
FIG. 1A is a partially transparent side view of a laundry appliance according to an embodiment of the present invention.

With reference to the drawings, FIG. 1A is a partially transparent side view of a laundry appliance 100 according to an embodiment of the present invention.

In the following, when one or more features of the laundry appliance (as well as method steps implemented by it) are introduced by the wording "according to an embodiment", they are to be construed as features additional or alternative to any features previously introduced, unless otherwise indicated and/or unless there is evident incompatibility among feature combinations.

The laundry appliance 100 comprises electric, electronic, mechanical, hydraulic, electromechanical and/or electrohydraulic components and/or systems (hereinafter, concisely, appliance components and/or systems), only the ones deemed relevant for the understanding of embodiments of the present invention being illustrated and discussed in the following for the sake of conciseness.

According to an embodiment, the laundry appliance 100 is a washing machine or a combined washer/dryer, i.e. a washing machine also having laundry drying functions.

According to an embodiment, the laundry appliance 100 comprises a control unit CU for controlling the laundry appliance 100 (the control unit CU being schematically illustrated as a dashed rectangle in FIG. 1A).

According to an embodiment, the control unit CU is configured to control (e.g., drive, power, interact with and/or exchange data with) the appliance components and/or systems, in order to manage the execution of selected treatment cycles, as progressively discussed in the following.

The implementation of the control unit CU is not limiting for the present invention.

Just as an example, the control unit CU may comprise a plurality of dedicated electronic sub-units (not shown) each one aimed at controlling one or more respective appliance components and/or systems, and a central electronic unit (not shown) for coordinating the plurality of dedicated control sub-units.

Just as another example, the control unit CU may comprise a single, common electronic unit.

In the following, when one or more of the appliance components and/or systems are said to be operated under the control of the control unit CU, it is meant that these components and/or systems may be equally operated by the respective dedicated electronic units or by the common electronic unit.

According to an embodiment, the control unit CU is configured to control the laundry appliance 100 according to instructions received by a user (such as a selection of a specific treatment cycle) through a user interface (not shown) of the laundry appliance 100.

According to an embodiment, the user interface may for example comprise a physical user interface (not shown).

According to an embodiment, the user interface may for example comprise a virtual user interface (not shown) provided by a mobile application running on a user device (such as a personal digital assistant (PDA), a smartphone, a tablet, a wearable smart device (such as a smartwatch) or other mobile device, not shown) external to the laundry appliance 100 and communicably coupled thereto (e.g., through a wired or wireless communication link).

According to an embodiment, the laundry appliance 100 comprises a (e.g., parallelepiped-shaped) cabinet 105.

According to an embodiment, the laundry appliance 100 comprises a laundry treatment chamber, such as a washing tub 110. According to an embodiment, the washing tub 110 is accommodated within the cabinet 105.

According to an embodiment, the laundry appliance 100 comprises a (e.g., rotatable) drum, not shown in the figures, adapted to receive laundry to be treated (e.g., to be washed), or laundry load. According to an embodiment, the drum is housed within the washing tub 110.

According to an embodiment, the laundry appliance 100 comprises, e.g. at a cabinet front, a loading opening 115 providing an access to the drum for loading/unloading the laundry load.

According to an embodiment, the laundry appliance 100 comprises a door 120 (shown in a closed position in FIG. 1A) for sealably closing the loading opening 115 during the operation of the laundry appliance 100.

According to an embodiment, the laundry appliance 100 comprises a water supply unit 122 configured to supply fresh water to the laundry appliance 100. According to an embodiment, the water supply unit 122 is located at a cabinet back, preferably at a top portion thereof.

According to an embodiment, the water supply unit 122 comprises a water inlet valve. According to an embodiment, the water inlet valve is connected to a fresh water hose behind the laundry appliance 100 (not shown). According to an embodiment, the fresh water hose is connected to an external water supply (such as the water mains, not shown). According to an embodiment, the water supply unit 122 may be operated in a first operating mode allowing the supply of fresh water to a treatment agent delivery system (discussed in the following), in a second operating mode allowing the supply of fresh water to a water softening system (discussed in the following), or in a third operating mode preventing the supply of fresh water to both the treatment agent delivery system and the water softening system. According to an embodiment, the water supply unit 122 may be operated in the first, second or third operating modes under the control of the control unit CU.

According to an embodiment, the laundry appliance 100 comprises an apparatus 125 for supplying process liquids into the washing tub 110.

According to an embodiment, the process liquids may comprise water (such as the fresh water or the softened water, as discussed in the following) or a treatment mixture including a laundry treatment agent mixed with water (i.e., a laundry treatment agent mixed with the fresh water or with the softened water).

According to an embodiment, the laundry treatment agent may comprise one or more among a washing detergent, a fragrance, a rinsing detergent, a bleach, a softener.

According to an embodiment, the apparatus 125 comprises a treatment agent delivery system configured to store amounts of one or more of the stored amounts of laundry treatment agents to be used for the generation of process liquid to be delivered into the washing tub 110 during an ongoing treatment cycle.

According to an embodiment, the selection of the laundry treatment agent and the delivery of process liquid into the washing tub 110 are performed by the treatment agent delivery system under the control of the control unit CU.

According to an embodiment, the treatment agent delivery system comprises a drawer 130 (discussed in the following).

According to an embodiment, the laundry appliance 100 comprises a drawer seat 136 for housing the drawer 130. According to an embodiment, the drawer 130 is adapted to slide within the drawer seat 136, along a longitudinal or sliding direction X, between an extracted position (not shown) and a retracted position (shown in FIG. 1A). According to an embodiment, the sliding direction X is parallel to a rest surface, such as the floor, on which the laundry appliance 100 rests in operation (i.e., when it is installed in the user premises).

According to an embodiment, the apparatus 125 comprises a water distribution system 132 for supplying water (e.g., the fresh water or the softened water, as discussed in the following) to the drawer 130 in order to obtain the process liquids. According to an embodiment, the water distribution system 132 comprises a flushing device (not shown) and a controllable valve assembly (not shown) selectively flushing the water towards specific regions of the drawer 130 (such as compartments and/or channels thereof, as discussed here below). According to an embodiment, the controllable valve assembly of the water distribution system 132 is operated under the control of the control unit CU.

According to an embodiment, the flushing device of the water distribution system 132 is provided atop the drawer 130, the flushing device for example acting also as a drawer upper cover.

According to an embodiment, the apparatus 125 comprises a process liquid outlet 134 for providing the process liquids to the washing tub 110. The water distribution system 132 and the process liquid outlet 134 form a process liquid delivery system of the apparatus 125 configured to steer water received by the apparatus 125 into selected portions/channels/compartments of the drawer 130 and to accordingly provide process liquid into the washing tub 110. Said process liquid delivery system is configured in such a way that the water (i.e., the fresh water or the softened water) output by the water distribution system 132 may be:

- mixed with one or more laundry treatment agent doses, so that the process liquids provided to the washing tub 110 through the process liquid outlet 134 comprise said water mixed with said one or more laundry treatment agent doses, or
- not mixed with any laundry treatment agent, so that the process liquids provided to the washing tub 110 through the process liquid outlet 134 comprise plain water.

According to an embodiment, the process liquids provided to the washing tub 110 through the process liquid outlet 134 may comprise water mixed with laundry treatment agent or the plain water depending on a current phase of a selected (and ongoing) treatment cycle performed by the laundry appliance 100. Just as an example, the process liquids may comprise water mixed with laundry treatment agent during pre-washing and washing phases of the treatment cycle, or the plain water during wetting and rinsing phases of the treatment cycle.

Figure 2B:
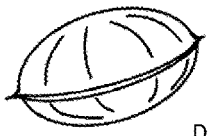
FIG. 2B shows an example of a pod that can be received in a compartment of the drawer of FIG. 2A.
Figure 2C:
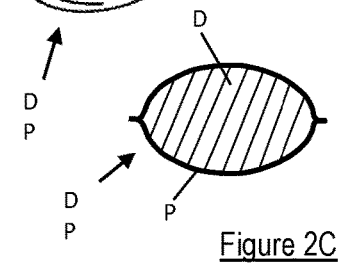
FIG. 2C is a section view of the pod of FIG. 2B.
Figure 2A:
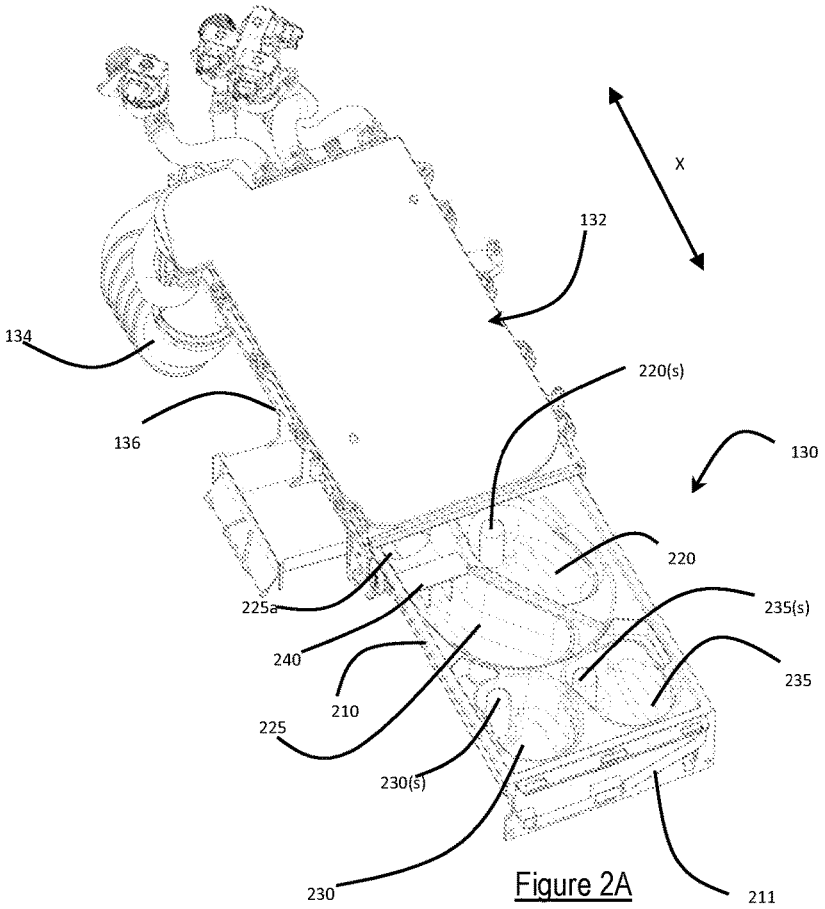
FIG. 2A shows a treatment agent delivery system comprising a drawer according to an embodiment of the present invention.

A treatment agent delivery system comprising the drawer 130 according to an embodiment of the present invention is illustrated in FIG. 2A. The drawer 130 is illustrated in FIG. 2A in the extracted position, i.e., at least partially extracted from the drawer seat 136.

According to an embodiment, the drawer 130 comprises a drawer body 210 and a drawer handle (not visible in FIG. 2A) coupled or connected to a front portion 211 of the drawer body 210. By interacting with the drawer handle, the user is allowed to slidably move the drawer 130 (along the sliding direction X) with respect to the drawer seat 136 between the extracted and retracted positions.

According to an embodiment, the drawer 130 comprises, behind the front portion 211 (taking the sliding direction X as a reference), one or more drawer compartments adapted to store amount(s) of laundry treatment agents. In the considered exemplary embodiment, four drawer compartments are provided and particularly:

- a first drawer compartment 220 adapted to receive an amount of liquid detergent;
- a second drawer compartment 225 adapted to receive an amount of powder detergent or a pod;
- a third drawer compartment 230 adapted to receive a softener;
- a fourth drawer compartment 235 adapted to receive other laundry treatment agents, such as fragrances, bleaches, dyes, additives.

It is pointed out that the four drawer compartments described above are only an example, and the concepts of the present invention can be applied in case the drawer 130 comprises a different number of drawer compartments.

A very simplified and non-limitative example of pod that can be received in the second drawer compartment 225 is illustrated in FIG. 2B with reference DP. A section view of the pod DP is illustrated in FIG. 2C. The exemplary pod DP illustrated in FIGS. 2B and 2C comprises a pre-measured amount, or single dose, of laundry treatment agent D incorporated into a water-soluble pouch P.

According to an embodiment, the laundry treatment agent D may comprise any type of detergent, for example powder, liquid, paste, waxy or gel compositions.

According to an embodiment, the pouch P comprises a water-soluble film. In some examples, the pouch P is a multi-compartment pouch adapted to store different laundry treatment agents D.

According to an embodiment, the pouch P may be made or may comprise a film that is soluble or dispersible in water, such as a polymeric film.

According to an embodiment, the first, third and fourth drawer compartments 220, 230, 235 are in fluid communication with the process liquid outlet 134 through a respective siphon element 220(*s*), 230(*s*), 235(*s*).

According to an embodiment, the second drawer compartment 225 is in fluid communication with the process liquid outlet 134 through an aperture 225(*a*) at the rear of the second drawer compartment 225. The second drawer compartment 225 preferably has a sloped bottom wall so that a fluid may flow toward the aperture 225(*a*).

According to an embodiment, the second drawer compartment 225 comprises a stopping device 240 at the aperture 225(*a*) adapted to avoid that a pod DP housed in the second drawer compartment 225 reach the aperture 225(*a*). The stopping device 240 is suited to stop the pod DP when the pod DP is intact while it is configured to allow the passage of the laundry treatment agent(s) D which exits the pod DP after the breakage of the pouch P caused by water provided in the second drawer compartment 225.

According to another embodiment not illustrated, the stopping device may be differently realized. For example, the second drawer compartment 225 itself may be properly shaped so that it accomplishes the function of stopping the pod DP inserted therein.

According to an alternative embodiment not illustrated, the second drawer compartment 225 does not comprise a stopping device nor is configured to provide the function of stopping the pod DP inserted therein.

According to an embodiment, the (flushing device of the) water distribution system 132 is configured to selectively channel water (i.e., fresh water or softened water):

- directly toward the process liquid outlet 134, so that the process liquid provided to the washing tub 110 comprises plain water, or
- into a selected one of the drawer compartments 220, 225, 230, 235, where it mixes with the laundry treatment agent contained therein, and a resulting mixture comprising water and laundry treatment agent is fed toward the process liquid outlet 134, so that the process liquid provided to the washing tub 110 comprises water mixed with laundry treatment agent.

Particularly, when the water distribution system 132 channels water in the first, third or fourth drawer compartments 220, 230, 235, process liquid in form of a mixture comprising water and laundry treatment agent reaches the process liquid outlet 134 (and therefore the washing tub 110) through the respective siphon element 220(*s*), 230(*s*), 235(*s*).

When the water distribution system 132 channels water in the second drawer compartment 225, the pouch P of the pod DP contained in the second drawer compartment 225 breaks, and process liquid in form of a mixture comprising water and the detergent laundry treatment agent(s) D stored in the pouch P reaches the process liquid outlet 134 (and therefore the washing tub 110) through the aperture 225(*a*).

Back to FIG. 1A, according to an embodiment, the laundry appliance 100 comprises a drain 140 for allowing process liquids contained in the washing tub 110 to be discharged from the laundry appliance 100. According to an embodiment, the drain 140 is located at the cabinet back, preferably at the top portion thereof.

According to an embodiment, the laundry appliance 100 comprises a water softening system 150 configured to receive the fresh water from the water supply unit 122 and to selectively provide the softened water (i.e., water having a level of hardness lower than the level of hardness of the fresh water) to the water distribution system 132 of the apparatus 125, so that the treatment agent delivery system (and particularly, the drawer 130) can be selectively supplied with softened water.

According to an embodiment, the water softening system 150 is operated under the control of the control unit CU. According to an embodiment, the control unit CU is configured to activate/deactivate the water softening system 150 to, respectively, allow/prevent the supply of the softened water from the water softening system to the water distribution system 132, and therefore to the treatment agent delivery system (as better discussed in the following).

As better discussed in the following, selective provision of the softened water to the treatment agent delivery system may be more effectively achieved by a peculiar implementation of the water softening system.

However, as better understood from the following discussion of exemplary and not limiting embodiments, the principles of selective provision of the softened water from the water softening system 150 to the treatment agent delivery system apply regardless of the specific implementation of the water softening system 150. Therefore, although in the following discussion explicit reference will be made to specific and particularly advantageous implementations of the water softening system 150, the principles of the present invention equivalently apply when considering any water softening system, including any water softening system known in the art.

According to an embodiment, the water softening system 150 comprises a water softening agent container 155 configured to store a water softening agent capable of reducing water hardness.

According to an embodiment, the water softening agent comprises an ion-exchange resin.

According to an embodiment, the water softening system 150 comprises a water tank 160 configured to store the softened water. As better discussed in the following, in alternative embodiments no water tank is provided in the water softening system 150.

According to an embodiment, the water softening system 150 is configured to supply the softened water (e.g., the softened water contained in the water tank 160, when the water tank 160 is provided in the water softening system 150) to the water distribution system 132 of the apparatus 125, so that the treatment agent delivery system (and particularly, the drawer 130) can be supplied with softened water.

According to an embodiment, the water softening system 150 comprises a salt container 165 configured to store salt. According to an embodiment, the salt stored in the salt container 165 is used for regenerating the water softening agent contained in the water softening agent container 155 during a water softening agent regeneration procedure.

According to an embodiment, the main components of the water softening system 150 are located in a bottom portion of the cabinet 105.

According to an embodiment, the water softening agent container 155 is located in a bottom and rear portion of the volume enclosed by the cabinet 105.

According to an embodiment, the water tank 160 is located (e.g., just) above the water softening agent container 155.

According to an embodiment, the salt container 165 is located at the bottom portion of the cabinet 105, in front of the water softening agent container 155 so that the salt container 165 can be accessed through an opening 170 provided on the cabinet front for allowing the salt container 165 to be refilled with new amounts of salt.

In this way, by exploiting the available space at the bottom and/or rear portions of the cabinet 105, it is advantageously possible to use a water softening agent container 155, a water tank 160 and/or a salt container 165 having a substantially large size, thereby improving the user experience without affecting treatment cycles performance.

According to an embodiment, a door 172 is advantageously provided on the cabinet front for selectively opening/closing the opening 170.

According to an embodiment, the salt container 165 is configured to be extracted from the cabinet 105 through the opening 170 for allowing an easy refilling of salt.

Figure 1B:
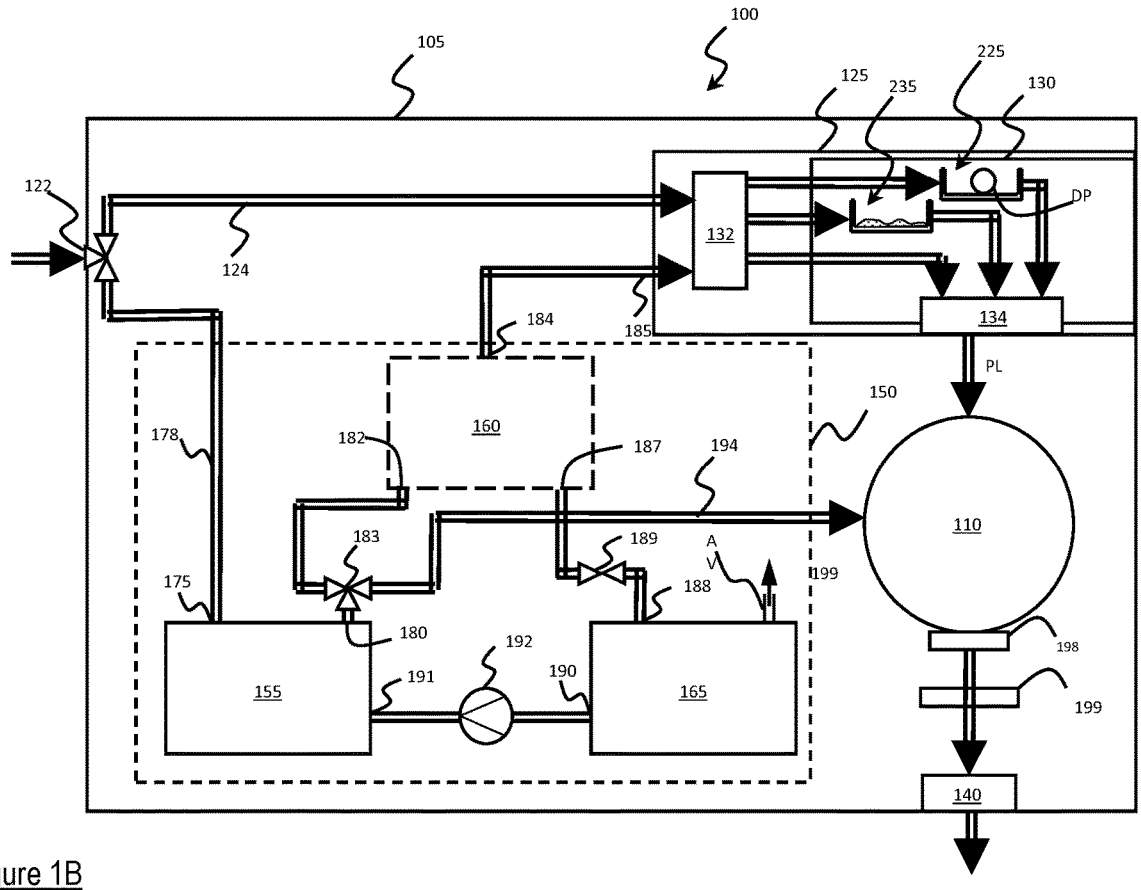
FIG. 1B shows, in terms of simplified functional blocks, a hydraulic circuit of the laundry appliance of FIG. 1A according to an embodiment of the present invention.

With joint reference to FIG. 1B, it shows, in terms of simplified functional blocks, a hydraulic circuit of the laundry appliance 100 according to an embodiment of the present invention.

According to an embodiment, the water softening agent container 155 has a first input 175 fluidly coupled to the water supply unit 122 for receiving the fresh water therefrom. According to an embodiment, the first input 175 of the water softening agent container 155 is fluidly coupled to the water supply unit 122 through a respective duct element 178. For example, the duct element 178 may be a, e.g., rigid, pipe vertically extending from the bottom portion of the volume enclosed by the cabinet 105 where the water softening agent container 155 is located up to the top portion of the cabinet back wherein the water supply unit 122 is located.

According to an embodiment, the first input 175 of the water softening agent container 155 is fluidly coupled to the water supply unit 122 when the water supply unit 122 is operated in the second operating mode.

According to an embodiment, the water supply unit 122 is fluidly coupled to the apparatus 125 (i.e., to the water distribution system 132, and hence to the treatment agent delivery system) when the water supply unit 122 is operated in the first operating mode. According to an embodiment, the water supply unit 122 is fluidly coupled to the apparatus 125 through a respective duct element 124.

According to an embodiment, the water softening agent container 155 has an output 180 for providing the softened water obtained from the received fresh water reacting with the water softening agent.

According to an embodiment, the water tank 160 has an input 182 configured to be selectively in fluid communication with the output 180 of the water softening agent container 155. According to an embodiment, the fluid communication between the output 180 of the water softening agent container 155 and the input 182 of the water tank 160 is selectively enabled by properly operating a water softening agent container valve 183 arranged at the output 180 of the water softening agent container 155, which will be described in greater detail in the following. According to an embodiment, the water softening agent container valve 183 is operated under the control of the control unit CU.

According to an embodiment, the water tank 160 has a first output 184 in fluid communication with the apparatus 125 (i.e., to the water distribution system 132, and hence to the treatment agent delivery system), so that the apparatus 125 can be supplied with softened water contained in the water tank 160. According to an embodiment, the first output 184 of the water tank 160 is fluidly coupled to the water distribution system 132 of the apparatus 125 through a duct element 185. According to an embodiment, the duct element 185 may be a, e.g., rigid, pipe vertically extending from the first output 184 of the water tank 160 to the apparatus 125. In the considered example, the duct element 185 extends from the first output 184 of the water tank 160 to the water distribution system 132.

According to an embodiment, the salt container 165 is configured to be selectively in fluid communication with the water tank 160 for receiving softened water from the latter. According to an embodiment, a second output 187 of the water tank 160 is configured to be selectively in fluid communication with an input 188 of the salt container 165. According to an embodiment, a water tank valve 189 is provided at the second output 187 of the water tank 160. According to an embodiment, the water tank valve 189 is operated under the control of the control unit CU. According to an embodiment, the water tank valve 189 is configured to be selectively opened during the water softening agent regeneration procedure for selectively causing the second output 187 of the water tank 160 to be in fluid communication with the input 188 of the salt container 165.

According to an embodiment, the salt container 165 comprises an output 190 fluidly connected to a second input 191 of the water softening agent container 155.

According to an embodiment, a pump device 192 is provided for selectively causing liquids coming from the output 190 of the salt container 165 to be pumped into the second input 191 of the water softening agent container 155. According to an embodiment, the pump device 192 is operated between an activated state (causing liquid pumping from the output 190 of the salt container 165 to the second input 191 of the water softening agent container 155) and a deactivated state (preventing liquid pumping from the output 190 of the salt container 165 to the second input 191 of the water softening agent container 155) under the control of the control unit CU.

According to an embodiment, the output 180 of the water softening agent container 155 is configured to be selectively fluidly coupled to the washing tub 110 through a duct element 194. For example, the duct element 194 may be a, e.g., rigid, pipe vertically extending from the output 180 of the water softening agent container 155 to the upper portion of the cabinet 105 and then reaching the washing tub 110.

According to the embodiment, the water tank 160 (when provided) is advantageously formed in a single piece with the duct element 178 and/or the duct element 194. By "formed in a single piece" it is herein intended that the water tank 160 and the duct element(s) 178 and/or 194 are manufactured—e.g., through a single molding step—so as to form a single assembly. By making reference to the exemplary embodiment of the invention illustrated in FIG. 1A, said single assembly provides for having the duct element 194 that is attached to a rear external surface of the water tank 160, and the duct element 178 that is attached to a rear external surface of the duct element 194. Similar considerations apply in case the water tank 160, the duct elements 178 and/or the duct element 194 are attached to each other in a different way.

According to another embodiment (not illustrated), the duct elements 178, 194 and the water tank 160 are not attached to each other to form a single assembly, but instead the duct elements 178, 194 are detached from the water tank 160.

In any case, irrespective of whether or not the duct element 178 and/or the duct element 194 are attached to the water tank 160 to form a single assembly, the fluid connections among these elements and the other elements of the water softening system 150 are arranged as depicted in the hydraulic circuit illustrated in FIG. 1B, or according to modification thereof that will be described in the following.

According to an embodiment, the fluid communication between the output 180 of the water softening agent container 155 and the washing tub 110 through the duct element 194 is selectively enabled by properly operating the water softening agent container valve 183 arranged at the output 180 of the water softening agent container 155.

According to an embodiment, the water softening agent container valve 183 is configured to be operated (under the control of the control unit CU) between a first operating mode and a second operating mode.

According to an embodiment, when the water softening agent container valve 183 is in the first operating mode, the output 180 of the water softening agent container 155 is in fluid communication with the input 182 of the water tank 160. According to an embodiment, when the water softening agent container valve 183 is in the first operating mode, fluid communication between the output 180 of the water softening agent container 155 and the washing tub 110 is prevented.

According to an embodiment, when the water softening agent container valve 183 is in the second operating mode, the output 180 of the water softening agent container 155 is in fluid communication with the washing tub 110. According to an embodiment, when the water softening agent container valve 183 is in the second operating mode, fluid communication between the output 180 of the water softening agent container 155 and the input 182 of the water tank 160 is prevented.

According to an embodiment, the water softening agent container valve 183 is configured to be operated in the second operating mode during or after the water softening agent regeneration procedure (so as to discharge a brine-residuals mixture, as discussed in the following).

According to an embodiment, the water softening agent container valve 183 is configured to be operated in a third operating mode in which fluid communication between the output 180 of the water softening agent container 155 and the washing tub 110, and fluid communication between the output 180 of the water softening agent container 155 and the input 182 of the water tank 160 are both prevented.

According to an alternative embodiment, not shown, the water softening agent container 155 may comprise a first output configured to be selectively in fluid communication with the input 182 of the water tank 160 and a second output (different from the first output) configured to be selectively in fluid communication with the washing tub 110.

According to an embodiment, the duct elements 124 and 185 are fluidly coupled to the controllable valve assembly of the water distribution system 132, so that the water distribution system 132 (and, hence, the drawer 130) is selectively fed with the fresh water from the water supply unit 122 (through the duct element 124), or with the softened water from the water tank 160 (through the duct element 185).

The peculiar arrangements of the water softening agent container 155 and of the water tank 160 with respect to each other and with respect to the water supply unit 122 allows reducing the number of components of the laundry appliance 100 that can be in contact with fresh water, thus avoiding or at least strongly reducing formation of limestone on laundry appliance components (such as on the walls of the water tank 160) that can potentially impair the correct operation of the laundry appliance 100.

According to an embodiment, operation of the water softening system 150 may be summarized as follows.

When the supply unit 122 is in the second operating mode, the fresh water from the external water supply is fed to the water softening agent container 155 through the duct element 178 and the first input 175.

The water softening agent contained in the water softening agent container 155 causes a reduction of the hardness of the received fresh water, thus obtaining corresponding softened water.

According to an embodiment, the water softening agent container valve 183 is then switched in the first operating mode, while the softened water tank valve 189 is kept closed and the pump device 192 is kept in the deactivated state, so that the output 180 of the water softening agent container 155 is in fluid communication with the water tank 160. In this condition, the water tank 160 is filled with softened water coming from the water softening agent container 155.

While softened water is provided through the water softening agent container 155, the level of softened water inside the water tank 160 increases and goes up the duct element 185, reaching the apparatus 125. In this condition, the water distribution system 132 (and, hence, the drawer 130) is fed with softened water coming from the water tank 160.

According to an embodiment, as discussed above, the water distribution system 132 is configured to cause the softened water to reach a selected one of the drawer compartments 220, 225, 230, 235 of the drawer 130 (see FIG. 2A), where it mixes with the laundry treatment agent contained therein before entering the process liquid outlet 134 or it enters unmixed the process liquid outlet 134. The selection of whether providing the softened water to one of the drawer compartments 220, 225, 230, 235 (and—in this case—the selection of the specific drawer compartment) or directly providing the softened water to the process liquid outlet 134 is carried out by the water distribution system 132 under control of the control unit CU based on a current phase of a selected (and ongoing) treatment cycle performed by the laundry appliance 100.

When the supply unit 122 is in the first operating mode, the fresh water from the external water supply is fed to the apparatus 125 through the duct element 124: thus, the water distribution system 132 (and, hence, the drawer 130) is fed with the fresh water coming from the supply unit 122.

In this condition, the water softening agent container valve 183 is switched in the third operating mode, the softened water tank valve 189 is kept closed and the pump device 192 is kept in the deactivated state.

According to an embodiment, as discussed above, the water distribution system 132 is configured to cause the fresh water to reach a selected one of the drawer compartments 220, 225, 230, 235 of the drawer 130 (see FIG. 2A), where it mixes with the laundry treatment agent contained therein before entering the process liquid outlet 134 or it enters unmixed the process liquid outlet 134. The selection of whether providing the fresh water to one of the drawer compartments 220, 225, 230, 235 (and—in this case—the selection of the specific drawer compartment) or directly providing the fresh water to the process liquid outlet 134 is carried out by the water distribution system 132 under control of the control unit CU based on a current phase of a selected (and ongoing) treatment cycle performed by the laundry appliance 100.

The process liquid, comprising plain soft water/fresh water or soft water/fresh water mixed with one or more laundry treatment agents, reaches then the washing tub 110 through the process liquid outlet 134.

Therefore:

when the water softening agent container valve 183 is in the first operating mode, the softened water tank valve 189 is closed and the pump device 192 is deactivated, the water softening system 150 is activated (with the supply unit 122 being in the second operating mode), so that softened water is supplied from the water softening system 150 (particularly, from the water tank 160) to the water distribution system 132 (and, therefore, to the treatment agent delivery system), whereas when the water softening agent container valve 183 is in the third operating mode, the softened water tank valve 189 is closed and the pump device 192 is deactivated, the water softening system 150 is deactivated (with the supply unit 122 being in the first operating mode) to prevent the supply of softened water from the water softening system 150 to the water distribution system 132 (and therefore to prevent the supply of softened water to the treatment agent delivery system).

According to an embodiment, the laundry appliance 100 comprises a heating element 198, such as a heating resistor, configured to be activated for heating up process liquid in the washing tub 110. According to an embodiment of the present invention, the heating element 198 is located at a bottom portion of the washing tub 110.

The amount of process liquid—and particularly the amount of soft/fresh water thereof—is set by the water distribution system 132 under control of the control unit CU based on a current phase of a selected (and ongoing) treatment cycle performed by the laundry appliance 100.

The temperature of the process liquid inside the washing tub 110 is set by the heating element 198 under control of the control unit CU based on a current phase of a selected (and ongoing) treatment cycle performed by the laundry appliance 100.

For example, when a first treatment cycle is selected providing for washing laundry in the washing tub 110 exploiting a pod stored in the second drawer compartment 225 of the drawer 130, during a laundry treatment agent delivering phase of said first treatment cycle, the control unit CU controls the water distribution system 132 to fed an amount of water into the drawer compartment 225. In this way, the process liquid provided into the washing tub 100 is obtained from such amount of water mixed with the laundry treatment agent contained in the pod. During a process liquid heating phase of said first treatment cycle, the control unit CU then controls the heating element 198 to heat up the process liquid inside the washing tub 110 to bring the latter at a temperature suitable to perform the selected washing operation.

As another example, when a second treatment cycle is selected providing for feeding steam into the washing tub 110 for refreshing the laundry located in the washing tub 110, and/or for smoothing out wrinkles from the laundry, during a steam generation phase of said second treatment cycle, the control unit CU controls the water distribution system 132 to feed a reduced amount of water directly to the process liquid outlet 134. In this way, a reduced amount of process liquid that does not contain laundry treatment agent reaches the bottom portion of the washing tub 110, covering the heating element 198 without soaking the laundry located in the washing tub 110. Then, the control unit CU controls the heating element 198 to heat up this reduced amount of process liquid covering the heating element 198 to bring the latter at a sufficiently high temperature for triggering the generation of steam. In this way, the generated steam propagates in the washing tub 110, refreshing the laundry located therein.

As a further example, when a third treatment cycle is selected for providing a fragrance to the laundry located in the washing tub 110 using a fragrance contained in the fourth drawer compartment 235 of the drawer 130, the control unit CU controls the water distribution system 132 to feed a reduced amount of water into the drawer compartment 235. In this way, a reduced amount of process liquid containing fragrance reaches the bottom portion of the washing tub 110, covering the heating element 198 without soaking the laundry located in the washing tub 110. Then, the control unit CU controls the heating element 198 to heat up this reduced amount of process liquid covering the heating element 198 to bring the latter at a sufficiently high temperature for causing the generation of fragranced steam. In this way, the generated fragranced steam propagates in the washing tub 110 and provides a fragrance to the laundry located therein.

According to an embodiment, in order to discharge the process liquids contained in the washing tub 110 from the laundry appliance 100, the washing tub 110 is put in fluid communication with the drain 140, for example by activating a proper valve element and/or a proper drain pump (not illustrated in the figures).

According to an embodiment, before reaching the drain 140, process liquids coming from the washing tub 110 are filtered by means of a corresponding drain filter, schematically illustrated in FIG. 1B and denoted by number reference 199.

According to an embodiment, operation of the water softening system 150 during the water softening agent regeneration procedure may be summarized as follows.

The water tank valve 189 at the second output 187 of the water tank 160 is opened, so that the water stored in the water tank 160 (which, depending on a status of the water softening agent, in this phase could be softened water having a low degree of softening or even non-softened water) is allowed to flow into the salt container 165 through the input 188. The softened water is mixed with salt contained in the salt container 165 so as to generate brine.

According to an embodiment, the salt container 165 is provided with an air vent duct AV configured to allow air inside the salt container 165 to exit the salt container 165 by a pressure of water coming into the salt container 165 through the input 188.

In this way, the salt container 165 can be filled with water in an efficient way, thereby avoiding or at least strongly reducing the formation of undesired air bubbles trapped inside the salt container 165.

According to an embodiment, the brine generated by the salt container 165 is provided to the water softening agent container 155. To this purpose, according to an embodiment, the pump device 192 is operated in the activated state, which causes the brine to be pumped out from the salt container 165 through the output 190 and to be pumped into the water softening agent container 155 through the second input 191 thereof.

The water softening agent contained in the water softening agent container 155 is then regenerated by allowing said water softening agent react with the brine for a predetermined amount of time RT. To this purpose, according to an embodiment, the water softening agent container valve 183 is switched to the third operating mode to prevent fluid communication with the water tank 160 and the washing tub 110, and, after that the water softening agent container 155 is filled with brine, the pump device 192 is temporally operated in the deactivated state during said predetermined amount of time RT.

According to an embodiment, the water softening agent container valve 183 is then switched to the second operating mode to cause the output 180 of the water softening agent container 155 to be in fluid communication with the washing tub 110, then the pump device 192 is operated in the activated state.

In this way, brine mixed with residuals of the water softening agent regeneration (hereinafter, brine-residuals mixture) is pumped through the duct element 194 toward the washing tub 110, and hence discharged through the drain 140.

Since the brine-residuals mixture is prevented from reaching the apparatus 125, no soiling of the apparatus 125 (and particularly no soiling of the drawer 130) is experienced (which otherwise could impair the subsequent treatment cycles).

In FIG. 1B embodiment, the output 180 of the water softening agent container 155 is in fluid communication with the drain 140, i.e., by skipping the apparatus 125. In this embodiment, the duct element 194 is directly in fluid communication with the washing tub 110.

In alternative embodiments (not illustrated), the duct element 194 may be arranged to be in fluid communication with the drain 140 bypassing the washing tub 110. For example, according to an embodiment, the duct element 194 may be arranged to be directly in fluid communication with the drain 140 or to be in fluid communication with the drain 140 through the filter element 198. In this way, it is avoided that the washing tub 110 get soiled with residuals of the water softening agent regeneration procedure.

Although preventing the brine-residuals mixture from reaching the apparatus 125 advantageously determines no soiling of the apparatus 125 (and particularly no soiling of the drawer 130), embodiments are not excluded in which the brine mixed with residuals of the water softening agent regeneration procedure is discharged into the drain 140 through the apparatus 125. In this embodiment, the output 180 of the water softening agent container 155 may be selectively put in fluid communication with the water distribution system 132 of the apparatus 125 for supplying process water. In this way, during a water softening agent regeneration procedure, the water delivery system 132 of the apparatus 125 for supplying process water is supplied with brine mixed with residuals of the water softening agent regeneration, coming from the water softening agent container 155. In this situation, the water delivery system 132 supplies the received brine mixed with residuals directly to the process liquid outlet 134. Thus, the brine mixed with residuals of the water softening agent regeneration is prevented from reaching the drawer compartments 220, 225, 230, 235 of the drawer 130, and hence the brine mixed with residuals of the water softening agent regeneration procedure water reaches the washing tub 110 (and then, the drain 140) without soiling the drawer compartments 220, 225, 230, 235 of the drawer 130 even if the apparatus 125 is being involved.

As better discussed in the following, the control unit CU is configured to operate the water supply unit 122:

in the first operating mode when the water softening system 150 is deactivated so that fresh water is supplied to the water distribution system 132 of the apparatus 125 and the process liquid supplied into the washing tub 110 through the process liquid output 134 is a treatment mixture including the treatment agent dose mixed with the fresh water (or the plain fresh water, as the case may be), and in the second operating mode when the water softening system 150 is activated, so that the water softening system 150 provides the softened water to the water distribution system 132 of the apparatus 125, and the process liquid supplied into the washing tub 110 through the process liquid output 134 is a treatment mixture including the treatment agent dose mixed with the softened water (or the plain softened water, as the case may be).

In general, according to embodiments of the invention, the control unit CU is configured to automatically activate/deactivate the water softening system 150 based on parameters associated to the operation of the laundry appliance 100. As will be described in greater detail in the following, said parameters associated to the operation of the laundry appliance that influence the automatic activation/deactivation of the water softening system 150 by the control unit CU comprise the selection of specific treatment cycles to be performed by the laundry appliance 100. Other parameter associated to the operation of the laundry appliance that influence the automatic activation/deactivation of the water softening system 150 by the control unit CU may comprise one or more of: the actual hardness of the fresh water received by water supply unit 122, the need of carrying out a water softening agent regeneration procedure, and the actual availability of a sufficient amount of softened water in the water tank 160.

In this way, according to embodiments of the invention, the water softening system 150 is automatically activated/deactivated without requiring the manual intervention of the user. The user is therefore freed from the duty of checking if the conditions favorable for the activation of the water softening system 150 are verified. Moreover, since according to the embodiments of the invention the water softening system 150 is activated only when required, the number of times the water softening agent regeneration procedure is carried out is advantageously reduced, reducing therefore the frequency with which the user is forced to provide new amounts of salt to guarantee the correct execution of water softening agent regeneration procedures.

Figure 3:
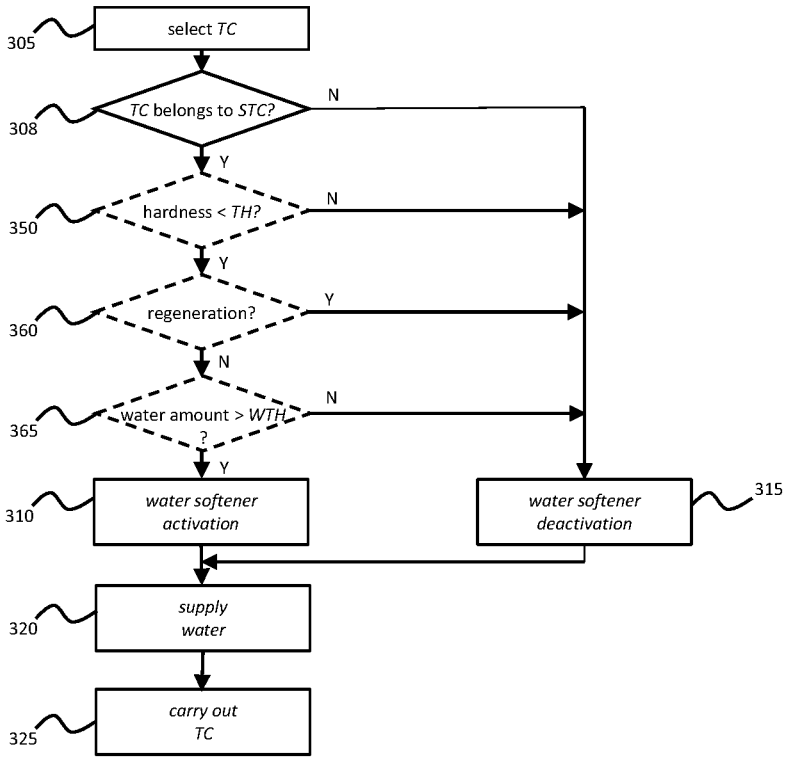
FIG. 3 shows an activity diagram of a procedure according to an embodiment of the present invention.

In order to show in greater detail the abovementioned automatic activation/deactivation of the water softening system 150, reference will be now made to FIG. 3, showing an activity diagram of a procedure 300 performed by the control unit CU according to the embodiments of the present invention.

According to an embodiment of the invention, when the user selects (e.g., through the laundry appliance 100 user interface) a treatment cycle TC (block 305), the control unit CU checks (block 308) if the selected treatment cycle TC belongs to a set STC of treatment cycles comprising:

a first treatment cycle TC(1) providing for washing laundry in the washing tub 110 exploiting a pod (e.g., the pod stored in the second drawer compartment 225 of the drawer 130);

a second treatment cycle TC(2) providing for feeding steam into the washing tub 110 for refreshing the laundry located in the washing tub 110.

According to an embodiment of the present invention, the set STC of treatment cycles further comprises a third treatment cycle TC(3) providing for fragrancing the laundry located in the washing tub 110 (e.g., using a fragrance contained in the fourth drawer compartment 235 of the drawer 130).

If the selected treatment cycle TC is one of the treatment cycles of the STC of treatment cycles (exit branch Y of block 308), the control unit CU activates the water softening system 150 (block 310). If the selected treatment cycle TC is different from the treatment cycles of the STC of treatment cycles (exit branch N of block 308), the control unit CU deactivates the water softening system 150 (block 315).

Then, the control unit CU controls the supply of water to the water distribution system 132 of the apparatus 125 (block 320).

If the water softening system 150 is activated, the control unit CU drives the water softening agent container valve 183 to the first operating mode and the supply unit 122 to the second operating mode, so that the water distribution system 132 of the apparatus 125 is supplied with softened water. In this case, the process liquid fed into the washing tub 110 through the process liquid output 134 comprises plain soft water or soft water mixed with a treatment agent contained in one of the compartments of the drawer 130 (depending on the current phase of the selected treatment cycle TC being carried out).

If the water softening system 150 is deactivated, the control unit CU drives the water softening agent container valve 183 to the third operating mode and the supply unit 122 to the first operating mode, so that the water distribution system 132 of the apparatus 125 is supplied with fresh water. In this case, the process liquid fed into the washing tub 110 through the process liquid output 134 comprises plain soft water or soft water mixed with a treatment agent contained in one of the compartments of the drawer 130 (depending on the current phase of the selected treatment cycle TC being carried out).

At this point, the laundry located in the washing tub 110 is properly treated based on the current phase of the selected treatment cycle TC being carried out (block 325). For example, if the selected treatment cycle TC is the first treatment cycle TC(1), the process liquid inside the washing tub 110 is properly heated up by the heating element 198 during a process liquid heating phase, and then the laundry is tumbled by a rotation of the drum during a tumbling phase. If the selected treatment cycle TC is the second treatment cycle TC(2) or the third treatment cycle TC(3), the process liquid inside the washing tub 110 is properly heated up by the heating element 198 up to cause the generation of steam during a steam generation phase or a fragrance phase.

According to an embodiment of the present invention, the activation of the water softening system 150 is carried out by the control unit CU conditioned to the results of one or more further additional checks (depicted in FIG. 3 in a dashed line) that are carried out by the control unit CU once the selected treatment cycle TC has been assessed to belong to the set STC of treatment cycles (i.e., when the exit Y of block 308 is selected).

According to an embodiment of the present invention, the control unit CU checks (block 330) if the hardness of the fresh water received through the water supply unit 122 is above a predefined threshold TH. For example, the laundry appliance 100 may be equipped with a proper water hardness sensor (not illustrated in the figures), e.g., located at the water supply unit 122.

If the hardness of water is assessed to be lower than the threshold TH (exit branch N of block 350), the control unit CU deactivates (block 315) the water softening system 150, because the hardness of the fresh water received from the water supply unit 122 is considered to be sufficiently low to be safely fed to the water distribution system 132 of the device 125 without requiring to be softened.

If the hardness of water is assessed to be above the threshold TH (exit branch Y of block 350), the control unit CU activate (block 310) the water softening system 150.

According to an embodiment of the present invention, the control unit CU checks (block 360) if the water softening system 150 need to be subjected (or if it is currently being subjected) to a water softening agent regeneration procedure.

If a water softening agent regeneration procedure has to be carried out (or if it is currently being carried out) because the water softening agent contained in the water softening agent container 155 is exhausted (exit branch Y of block 360), the control unit CU deactivates (block 315) the water softening system 150 because in this situation the water softening system 150 is not capable of dispensing softened water.

If instead no water softening agent regeneration procedure has to be carried out (exit branch N of block 360) the control unit CU activate (block 310) the water softening system 150.

According to an embodiment of the present invention, the control unit CU checks (block 365) if the amount of softened water contained in the water tank 160 is above a predefined threshold WTH. For example, this checks may be carried out by means of a proper water level sensor (not illustrated in the figures), e.g., located at the water tank 160.

If the amount of softened water contained in the water tank 160 is assessed to be lower than the predefined threshold WTH (exit branch N of block 365), the control unit CU deactivates (block 315) the water softening system 150 because in this situation the water softening system 150 is not capable of dispensing a sufficient amount of softened water.

If instead the amount of softened water contained in the water tank 160 is assessed to be higher than the predefined threshold WTH (exit branch Y of block 365) the control unit CU activate (block 310) the water softening system 150, because in this situation the water softening system 150 is capable of dispensing a sufficient amount of softened water.

In the exemplary embodiment of the invention illustrated in FIG. 3, the further additional checks corresponding to blocks 350, 360, 365 after the check corresponding to block 308 have been carried out following a specific sequence. However, similar considerations apply in case the further additional checks (if present) are carried out in a different order or are carried out in parallel to each other. The only requirement is that the control unit CU is configured to activate the water softening system 150 (block 310) only when—once the selected treatment cycle TC is assed to be one of the treatment cycles of the set STC of treatment cycles (exit branch Y of block 308)—, all the considered further additional checks corresponding to block(s) 350, 360, and/or 365 produce results that provides for an activation of the water softening system 150.

According to a further embodiment of the invention (not illustrated in FIG. 3), the control unit CU is configured to automatically select the first treatment cycle TC(1) providing for washing laundry in the washing tub 110 exploiting a pod when a pod is received in the second drawer compartment 225 of the drawer (see FIG. 2A).

According to a further embodiment of the invention (not illustrated in FIG. 3), the control unit CU is configured to not deactivate the water softening system 150 even when the selected treatment cycle TC is different from the previously described treatment cycles TC(1), TC(2), TC(3). For example, the control unit CU may be configured to not deactivate the water softening system 150 when the selected treatment cycle TC is a standard treatment cycle providing for washing laundry in the washing tub 110 exploiting liquid detergent stored in the first drawer compartment 220 of the drawer 130.

Although in the foregoing explicit reference has been exemplary made to specific embodiments of the water softening system 150, the principles of the present invention equivalently apply when considering other implementations of the water softening system. In this respect, according to alternative embodiments, not shown in the figures, the water softening system 150 may be any type of water softening system known in the art, for example a water softening system without a water tank 160 configured to store softened water (for this reason, the water tank 160 is depicted in FIG. 1B with dashed line). In these embodiments, such a water softening system may be configured (similarly to the water softening system 150) to receive the fresh water from the water supply unit 122 and to selectively provide the softened water to a treatment agent delivery system.

In other words, in these embodiments, such a water softening system may be configured to receive the fresh water from the water supply unit 122 and to selectively provide the softened water directly (i.e., without interposition of the water tank) to the treatment agent delivery system. For example, the water the output 180 of the water softening agent container 155 can be arranged to be directly in fluid communication with the water distribution system 132. Similarly, the input 188 of the salt container 165 may be arranged to be directly in fluid communication with the water supply unit 122 to receive fresh water.

Obviously, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry treatment appliance comprising:

a water supply unit configured to supply fresh water to the laundry treatment appliance;

a laundry treatment chamber adapted to receive laundry to be treated;

a water softening system configured to receive fresh water from the water supply unit and to generate soft water from the received fresh water;

a process liquid delivery system fluidly connected to said water supply unit, said water softening system, and at least one of:

a treatment agent delivery system configured to store a water-soluble pod containing one or more laundry treatment agents, and a steam generator to be supplied into the laundry treatment chamber;

wherein the process liquid delivery system is configured to supply process liquid comprising fresh water supplied by the water supply unit or soft water generated by the water softening system into the laundry treatment chamber;

wherein the laundry treatment appliance is configured to perform at least one among a set of treatment cycles selectable by a user, said set of treatment cycles comprising at least one of:

a first treatment cycle in which said process liquid supplied by said process liquid delivery system further comprises said one or more laundry treatment agents contained in said water-soluble pod, and a second treatment cycle in which the steam generator is activated for supplying steam into the laundry treatment chamber using water supplied by the process liquid delivery system;

wherein the laundry treatment appliance further comprises a control unit configured to activate the water softening system so as to provide the process liquid delivery system with soft water when one of said treatment cycles of the set of treatment cycles is selected.

2. The laundry treatment appliance of claim 1, wherein the control unit is further configured to deactivate the water softening system so as provide the process liquid delivery system with fresh water supplied by the water supply unit when none of said treatment cycles of the set of treatment cycles is selected.

3. The laundry treatment appliance of claim 1, wherein the control unit is configured to activate the water softening system so as to provide the process liquid delivery system with soft water when one of said treatment cycles of the set of treatment cycles is selected and hardness of said fresh water is above a predefined threshold.

4. The laundry treatment appliance according to claim 1, wherein the control unit is configured to activate the water softening system so as to provide the process liquid delivery system with soft water when one of said treatment cycles of the set of treatment cycles is selected and no regeneration of the water softening system is required.

5. The laundry treatment appliance according to claim 1, wherein the water softening system comprises a water tank configured to store softened water, the water softening system being configured to supply soft water contained in said water tank to said process liquid delivery system.

6. The laundry treatment appliance according to claim 5, wherein said water softening system comprises a water softening agent container storing a water softening agent capable of reducing hardness of water, and wherein said water tank has an input configured to be selectively in fluid communication with an output of said water softening agent container, and an output in fluid communication with said process liquid delivery system.

7. The laundry treatment appliance according to claim 5, wherein the control unit is configured to activate the water softening system so as to provide the process liquid delivery system with soft water based on an amount of soft water stored in the water tank.

8. The laundry treatment appliance according to claim 5, wherein the control unit is configured to activate the water softening system when one of said treatment cycles of the set of treatment cycles is selected and said amount of soft water stored in the water tank is higher than a predefined soft water amount threshold.

9. The laundry treatment appliance according to claim 1, wherein the treatment agent delivery system is further configured to store a fragrance, said set of treatment cycles further comprising a third treatment cycle in which said process liquid supplied by said delivery system further comprises said fragrance.

10. The laundry treatment appliance according to claim 9, wherein said treatment agent delivery system comprises at least one fragrance compartment adapted to receive said fragrance.

11. The laundry treatment appliance according to claim 1, further comprising a user interface, the control unit being further configured to set one of said treatment cycles in response to selection input provided by a user through said user interface.

12. The laundry treatment appliance according to claim 1, wherein said control unit is configured to automatically activate the water softening system so as to provide the process liquid delivery system with soft water when said water-soluble pod is received in said treatment agent delivery system.

13. The laundry treatment appliance according to claim 1, wherein said treatment agent delivery system comprises at least one pod compartment adapted to receive said water-soluble pod.

14. The laundry treatment appliance according to claim 1, wherein said steam generator comprises a heating element located at a bottom portion of the laundry treatment chamber.

15. A method for operating a laundry treatment appliance, the laundry treatment appliance comprising:

a water supply unit configured to supply fresh water to the laundry treatment appliance;

a laundry treatment chamber adapted to receive laundry to be treated;

a water softening system configured to receive fresh water from the water supply unit and to generate soft water from the received fresh water;

a process liquid delivery system fluidly connected to said water supply unit, to said water softening system, and fluidly connected to one or both of a steam generator to be supplied into the laundry treatment chamber, and a treatment agent delivery system configured to store a water-soluble pod containing one or more laundry treatment agents;

wherein the process liquid delivery system is configured to supply process liquid comprising fresh water supplied by the water supply unit or soft water generated by the water softening system into the laundry treatment chamber;

wherein the laundry treatment appliance is configured to perform at least one among a set of treatment cycles selectable by a user, said set of treatment cycles comprising at least one of: a first treatment cycle in which said process liquid supplied by said process liquid delivery system further comprises said one or more laundry treatment agents contained in said water-soluble pod, and a second treatment cycle in which the steam generator is activated for supplying steam into the laundry treatment chamber using water supplied by the process liquid delivery system;

wherein the method comprises:

selecting a treatment cycle to be performed by the laundry treatment appliance; and performing the selected treatment cycle by activating the water softening system so as to provide the process liquid delivery system with soft water if said selected treatment cycle is a treatment cycle of said set of treatment cycles.

16. The method according to claim 15, further comprising performing the selected treatment cycle by deactivating the water softening system so as provide the process liquid delivery system with fresh water supplied by the water supply unit if said selected treatment cycle is not a treatment cycle of said set of treatment cycles.

* * * * *